US010280709B2

(12) United States Patent
Williamson, Jr. et al.

(10) Patent No.: US 10,280,709 B2
(45) Date of Patent: May 7, 2019

(54) VALVES FOR AUTONOMOUS ACTUATION OF DOWNHOLE TOOLS

(71) Applicant: Halliburton Energy Services, Inc., Houston, TX (US)

(72) Inventors: Jimmie R. Williamson, Jr., Carollton, TX (US); Adam E. Beck, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 641 days.

(21) Appl. No.: 14/760,970

(22) PCT Filed: Apr. 29, 2014

(86) PCT No.: PCT/US2014/035910
§ 371 (c)(1),
(2) Date: Jul. 14, 2015

(87) PCT Pub. No.: WO2015/167467
PCT Pub. Date: Nov. 5, 2015

(65) Prior Publication Data

US 2016/0273308 A1 Sep. 22, 2016

(51) Int. Cl.
*E21B 34/08* (2006.01)
*E21B 34/14* (2006.01)
(Continued)

(52) U.S. Cl.
CPC ..... *E21B 34/08* (2013.01); *E21B 34/14* (2013.01); *E21B 43/12* (2013.01); *E21B 33/12* (2013.01);
(Continued)

(58) Field of Classification Search
CPC ..... E21B 34/14; E21B 47/00; E21B 34/08; E21B 43/12; E21B 2034/007;
(Continued)

(56) References Cited

U.S. PATENT DOCUMENTS 5,730,219 A 3/1998 Tubel et al.
5,829,520 A 11/1998 Johnson
(Continued)

FOREIGN PATENT DOCUMENTS

WO 2000066880 11/2000

OTHER PUBLICATIONS

International Search Report and Written Opinion of PCT Application No. PCT/US2014/035910 dated May 1, 2015: pp. 1-15.

*Primary Examiner* — Michael R Wills, III
(74) *Attorney, Agent, or Firm* — Chamberlain Hrdlicka

(57) ABSTRACT

An autonomous valve includes a fluid-sensitive actuator operable to automatically actuate the valve in response to being exposed to a target fluid. The target fluid may be a fluid whose presence is generally undesirable in a production fluid, such as water, and the valve may be actuated to stop flow from an interval within a wellbore that is no longer expected to produce hydrocarbon-bearing fluids. The valve further includes a protective layer disposed between the fluid inlet and the fluid-sensitive actuator, the protective layer being insoluble in the target fluid. The fluid-sensitive actuator may include a swellable piston that swells to actuate the valve in the presence of the target fluid, a soluble plug that isolates a hydraulic, closing piston until the soluble plug is dissolved into the target fluid, and an electromechanical actuator that closes the valve in response to detecting the target fluid using an electronic sensor.

10 Claims, 5 Drawing Sheets

(51) Int. Cl.

| | |
|---|---|
| ***E21B 43/12*** | (2006.01) |
| *E21B 33/12* | (2006.01) |
| *E21B 34/06* | (2006.01) |
| *E21B 34/00* | (2006.01) |

(52) U.S. Cl.
CPC ..... *E21B 34/066* (2013.01); *E21B 43/121* (2013.01); *E21B 2034/007* (2013.01)

(58) Field of Classification Search
CPC ..... E21B 43/121; E21B 34/066; E21B 33/12; E21B 34/063; E21B 34/085; E21B 44/005
See application file for complete search history.

(56) References Cited

U.S. PATENT DOCUMENTS

| | | | | |
|---|---|---|---|---|
| 7,451,815 | B2 | 11/2008 | Hailey, Jr. | |
| 7,591,319 | B2 | 9/2009 | Xu | |
| 7,828,067 | B2 * | 11/2010 | Scott | E21B 43/12 166/386 |
| 8,231,947 | B2 * | 7/2012 | Vaidya | E21B 34/14 166/192 |
| 8,485,265 | B2 | 7/2013 | Marya et al. | |
| 8,544,548 | B2 | 10/2013 | Coronado et al. | |
| 8,550,103 | B2 | 10/2013 | Chen et al. | |
| 2007/0246225 | A1 * | 10/2007 | Hailey, Jr. | E21B 21/103 166/386 |
| 2008/0236843 | A1 | 10/2008 | Scott et al. | |
| 2008/0262735 | A1 | 10/2008 | Thigpen et al. | |
| 2009/0101329 | A1 * | 4/2009 | Clem | E21B 43/12 166/66.6 |
| 2009/0101341 | A1 | 4/2009 | Willauer | |
| 2012/0211239 | A1 | 8/2012 | Kritzler et al. | |
| 2012/0255739 | A1 * | 10/2012 | Fripp | E21B 43/12 166/273 |
| 2013/0008648 | A1 | 1/2013 | Lovorn et al. | |
| 2013/0056221 | A1 | 3/2013 | Johannessen | |
| 2013/0180725 | A1 | 7/2013 | Richard et al. | |
| 2013/0248193 | A1 | 9/2013 | Brekke | |
| 2014/0020898 | A1 * | 1/2014 | Holderman | E21B 43/08 166/304 |
| 2014/0318780 | A1 * | 10/2014 | Howard | E21B 23/06 166/285 |
| 2014/0338922 | A1 * | 11/2014 | Lopez | E21B 34/066 166/373 |

* cited by examiner

VALVES FOR AUTONOMOUS ACTUATION OF DOWNHOLE TOOLS

FIELD OF THE INVENTION

The present disclosure relates generally to the recovery of subterranean deposits, and more specifically to an actuator used to open or close valves in a production string.

DISCUSSION OF THE RELATED ART

Crude oil and natural gas occur naturally in subterranean deposits and their extraction includes drilling a well. The well provides access to a production fluid that often contains crude oil and natural gas. Drilling of the well generally involves deploying a drill string into a formation. The drill string includes a drill bit that removes material from the formation as the drill string is lowered to form a wellbore. After drilling and prior to production, a casing may be deployed in the wellbore to isolate portions of the wellbore wall and prevent the ingress of fluids from parts of the formation that are not likely to produce desirable fluids. After completion, a production string may be deployed into the well to facilitate the flow of desirable fluids from producing areas of the formation to the surface for collection and processing.

A variety of packers and other tools may operate in the wellbore to fix the production string relative to a casing or wellbore wall, and may also function to isolate production zones (also referred to as "intervals") of the well so that hydrocarbon-rich fluids are collected from the wellbore in favor of undesirable fluids (such as water). These packers and tools may operate in a wide variety of downhole environments, including extreme downhole environments having very high pressures and very high temperatures.

Valves may be incorporated into the production string at intervals between packers to allow or cease flow into the production string from the production zone that abuts the wellbore between the packers. Such a valve may be referred to as an interval control valve.

BRIEF DESCRIPTION OF THE DRAWINGS

Illustrative embodiments of the present disclosure are described in detail below with reference to the attached drawing figures, which are incorporated by reference herein and wherein.

Figure 1:
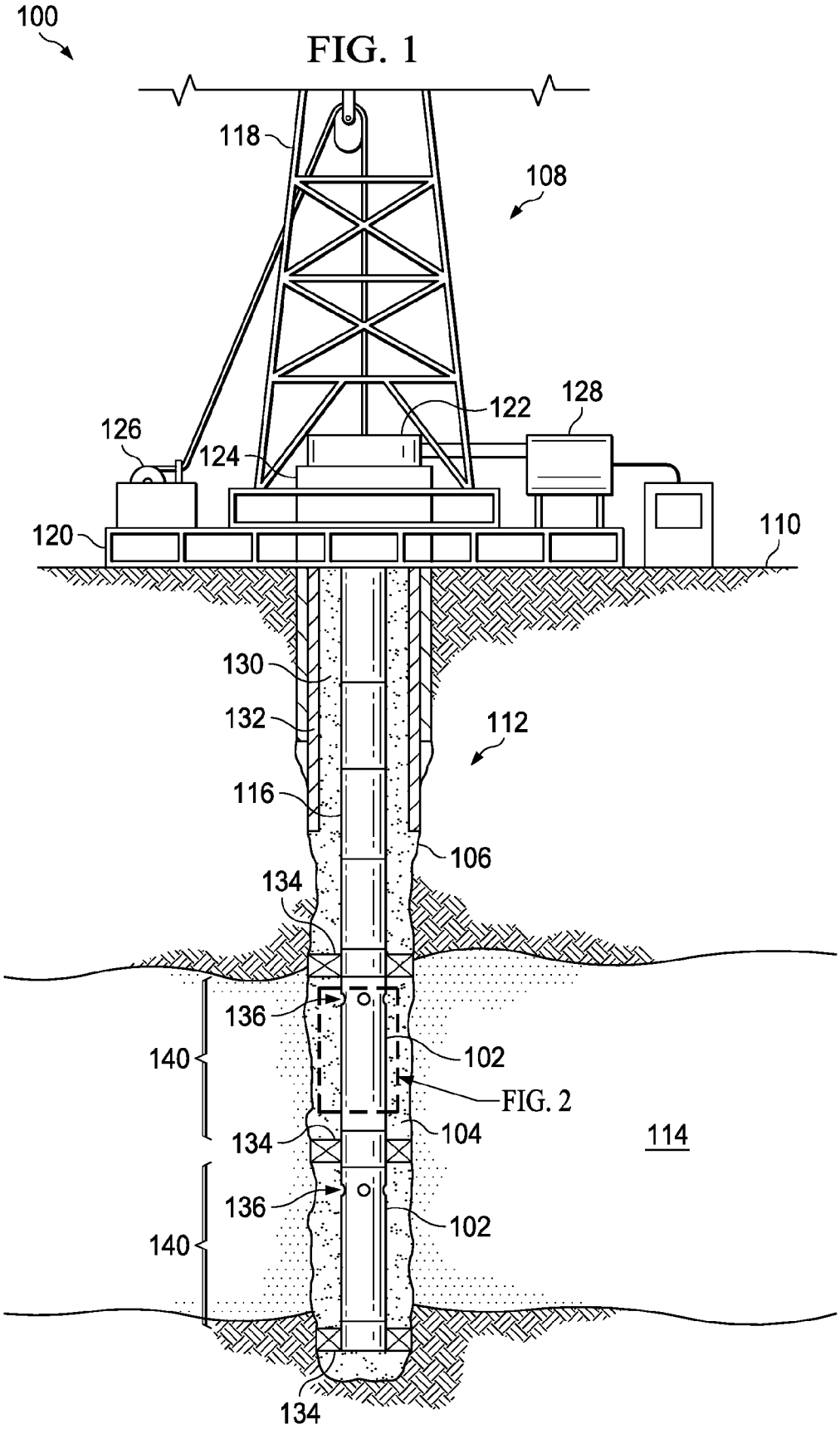
FIG. 1 is a schematic, elevation view with a portion shown in cross-section of a system for autonomously actuating a valve downhole in response to a production fluid from a wellbore.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

In the drawings and description that follow, like parts are typically marked throughout the specification and drawings with the same reference numerals or coordinated numerals. The drawing figures are not necessarily to scale. Certain features of the illustrative embodiments may be shown exaggerated in scale or in somewhat schematic form and some details of conventional elements may not be shown in the interest of clarity and conciseness.

The embodiments described herein relate to systems, tools, and methods for actuating a downhole tool, such as an interval control valve. As noted previously, valves may be incorporated into the production string at intervals between packers to allow or cease flow into the production string from the portion of the formation that abuts the wellbore between the packers, and such valves may be referred to as interval control valves. The illustrative embodiments described herein relate to a fluid-sensitive actuator that automatically initiates an interval control valve to close an entrance to a production string from a wellbore in response to detecting an undesirable characteristic of a production fluid, such as a high concentration of water.

In an illustrative embodiment, an autonomous valve actuation system includes a tubing segment, which may be a segment of a production string. The tubing segment includes a conduit and a valve, and may be disposed within a wellbore between a set of packers that isolate the tubing segment to a production zone of the wellbore. The valve includes an inlet and an outlet, and defines a fluid flow path between the inlet and the outlet. The inlet is fluidly coupled to an exterior of the tubing segment and the outlet is fluidly coupled to the conduit. The valve includes a fluid-sensitive actuator that is operable to automatically close the valve in response to detecting, for example, a concentration of water in a production fluid that flows through the valve.

In an embodiment, the system further includes a protective layer between a fluid inlet of the fluid-sensitive actuator and the exterior of the tubing segment. The protective layer may be soluble in a hydrocarbon-bearing production fluid, and may be formed from natural rubber latex, a triacylglycol, a phospholipid, a glycolipid, hydrophobic proteins, or aliphatic hydrocarbons. The system may also include a swellable piston that in turn includes a material that is absorbent of the water and inabsorbent of a hydrocarbon-bearing production fluid, and is operable to swell in the presence of water to initiate closing of the valve.

In an embodiment, the fluid-sensitive actuator includes a soluble plug disposed between the exterior of the tubing segment and a fluid inlet of the fluid-sensitive actuator, the soluble plug being soluble in a target fluid, such as water. Such a system may further include a fluid motivated piston coupled to a valve closing member that is disposed between the soluble plug and a chamber at a first pressure, such as an atmospheric chamber. The fluid motivated piston may be operable to motivate the valve closing member to a closed position in response to fluid entering the fluid inlet of the fluid-sensitive actuator at a wellbore pressure that is greater than the pressure in the chamber.

In another exemplary embodiment, the fluid-sensitive actuator includes an electromechanical actuator having a controller, a power source, and an electronic sensor. The fluid-sensitive actuator is operable to actuate the valve in response to the electronic sensor detecting a trigger condition, such as the presence of water in the production fluid.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

The various characteristics mentioned above, as well as other features and characteristics described in more detail below, will be readily apparent to those skilled in the art with the aid of this disclosure upon reading the following detailed description of the embodiments, and by referring to the accompanying drawings.

Referring now to the figures, FIG. 1 shows an illustrative embodiment of a system 100 having an autonomously actuated, internal control valve 102. The system 100 is depicted in a schematic, elevation view with a portion shown in cross-section. The system 100 includes a rig 108 atop a surface 110 of a well 112. Beneath the rig 108, a wellbore 106 is formed within a geological formation 114, which is expected to produce hydrocarbons in the form of production fluid 104. The wellbore 106 may be formed in the geological formation 114 using a drill string that includes a drill bit to remove material from the geological formation 114. The wellbore 106 of FIG. 1 is shown as being near-vertical, but may be formed at any suitable angle to reach a hydrocarbon-rich portion of the geological formation 114. In some embodiments, the wellbore 106 may follow a vertical, partially-vertical, angled, or even a partially-horizontal path through the geological formation 114.

A production tool string 116 is deployed from the rig 108, which may be a drilling rig, a completion rig, a workover rig, or another type of rig. The rig 108 includes a derrick 118 and a rig floor 120. The production tool string 116 extends downward through the rig floor 120, through a fluid diverter 122 and blowout preventer 124 that provide a fluidly sealed interface between the wellbore 106 and external environment, and into the wellbore 106 and geological formation 114. The rig 108 may also include a motorized winch 126 and other equipment for extending the production tool string 116 and other tools into the wellbore 106, retrieving the production tool string 116 or other tools, from the wellbore 106, and positioning the production tool string 116 or other tools at a selected depth within the wellbore 106. Coupled to the fluid diverter 122 is a pump 128. The pump 128 is operational to deliver or receive fluid through an internal bore of the production tool string 116 by applying a positive or negative pressure to the internal bore. The pump 128 may also deliver or receive fluid through an annulus 130 formed between the wall of the wellbore 106 and an exterior of the production tool string 116 by applying a positive or negative pressure to the annulus 130. The annulus 130 is formed between the production tool string 116 and a wellbore casing 132 when production tool string 116 is disposed within the wellbore 106.

Following formation of the wellbore 106, the production tool string 116 may be equipped with tools and deployed within the wellbore 106 to prepare, operate, or maintain the well 112. Specifically, the production tool string 116 may incorporate tools that are actuated after deployment in the wellbore 106, including without limitation bridge plugs, composite plugs, cement retainers, high expansion gauge hangers, straddles, and packers. Actuation of such tools may result in centering the production tool string 116 within the wellbore 106, anchoring the production tool string 116, isolating a segment of the wellbore 106, or other functions related to positioning and operating the production tool string 116. In the illustrative embodiment shown in FIG. 1, the production tool string 116 is depicted with packers 134 within a production zone of the geological formation 114. The packers 134 are configured to provide fluid seals between the production tool string 116 and the wellbore 106, thereby defining intervals within the production zone. Packers 134 are typically used to prepare the wellbore 106 for hydrocarbon production during operations such as fracturing of the formation or for service during formation of the well during operations such as acidizing or cement squeezing.

Between the packers 134 are valves 102 that control the flow of production fluid 104 into the production string 116 at each interval 140. The illustrative valves 102, which may also be referred to as interval control valves, are located proximate the production zone and configured to self-actuate, or close, in response to the presence of a target fluid in the production fluid or in response to detecting that a parameter of the production fluid 104 has reached a predetermined value. Non-limiting examples of production fluid parameters include chemical compositions, chemical concentrations, pressures, temperatures, and exposure times. The aforementioned target fluid may be any fluid that is generally considered undesirable in a hydrocarbon-producing well. In an embodiment, the target fluid is water and the valve 102 is autonomously actuated in response to water flowing into the production string 116 from the formation 114.

In some embodiments, the valves 102 actuate after being exposed for a predetermined time to water (target fluid) in the production fluid 104. In other embodiments, the valves 102 actuate when a concentration of an undesired substance in the production fluid 104 exceeds a threshold value. For example, the concentration of an undesired substance may be a high concentration of water or brine containing toxic metals or radioactive substances like radium, CO2, H2S or high sulfur content, heavy crude with an American Petroleum Institute (API) gravity measurement of greater than ten, or a high bitumen content. Although FIG. 1 depicts the valves 102 as being separated by packers 134, this illustration is not intended as limiting, and other arrangements of valves 102 in the production tool string 116 are possible. For example, the valves 102 may be integrated into the production tool string 116 adjacent hydraulic fracturing sleeves. Furthermore, while FIG. 1 presents the production tool string 116 as having two valves 102, such presentation is for purposes of illustration only. The present disclosure is not limited to any particular number of valves 102 or arrangement of valves 102 relative to packers 134 or intervals 140.

In operation, the valves 102 are typically opened by applying and relieving an internal pressure that exceeds an exterior pressure in the annulus 130. Regulation of pressure as used to open valves 102 is controlled in part by the pump 128, which manipulates fluid in the annulus 130 and the internal bore of the production tool string 116. Applying and relieving the internal pressure opens an internal sliding sealing member that exposes or covers one or more flow ports 136 of the valve 102. When exposed, flow ports 136 allow fluid to into the production string 116 to facilitate the collection and extraction of the production fluid 104. The valves 102 may be configured to autonomously close the sliding sealing member in response to a trigger condition. A trigger condition may be exposure to an undesirable fluid, such as water, or the parameter of the production fluid 104 reaching the predetermined value. However, it will be appreciated that the valves 102 are not limited by such embodiments. Other movable members may be autonomously actuated by the valves 102. Furthermore, in some embodiments, the valves 102 may be activated differently than by applying and relieving an internal pressure. In other embodiments, the valves 102 may require no activation at all.

It is noted that while the operating environment shown in FIG. 1 relates to a stationary, land-based rig for raising, lowering, and setting the production tool string 114, in alternative embodiments, mobile rigs, wellbore servicing units (e.g., coiled tubing units, slickline units, or wireline units), and the like may be used to lower the production tool string 114. Furthermore, while the operating environment is generally discussed as relating to a land-based well, the systems and methods described herein may instead be operated in subsea well configurations accessed by a fixed or floating platform.

Figure 2A:
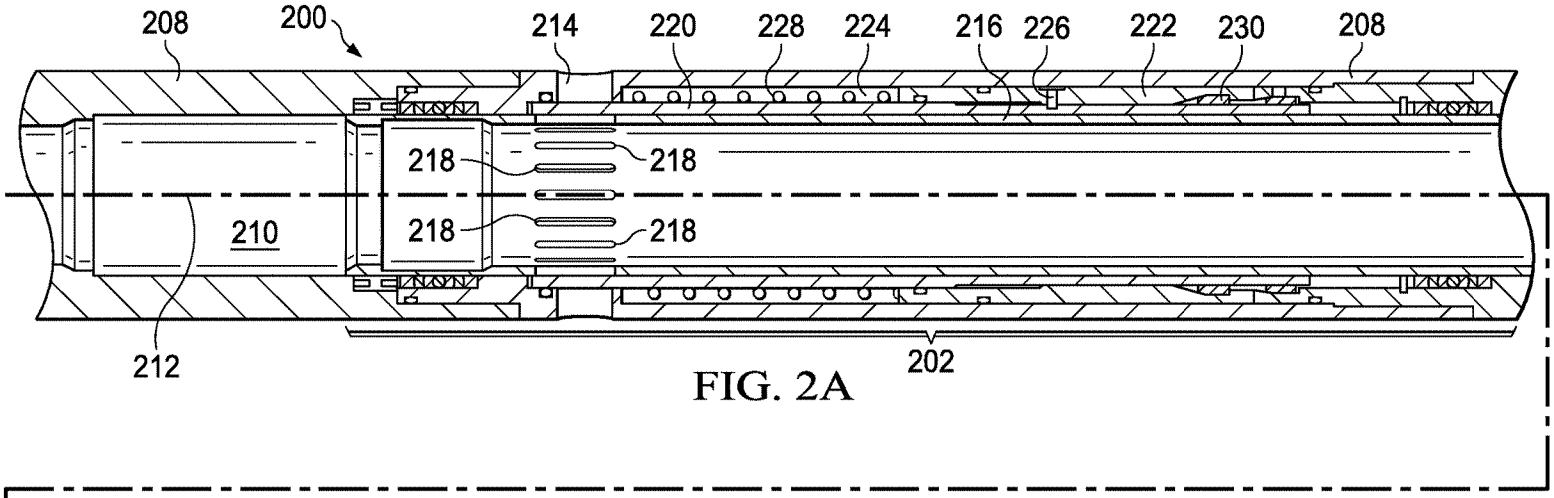
FIGS. 2A and 2B present a detail, cross-sectional view, as indicated in FIG. 1, of an autonomously activated valve having a sliding side door that is operable to seal the valve and a fluid-sensitive actuator that contains a swellable piston, in an unactuated position.
Figure 2B:
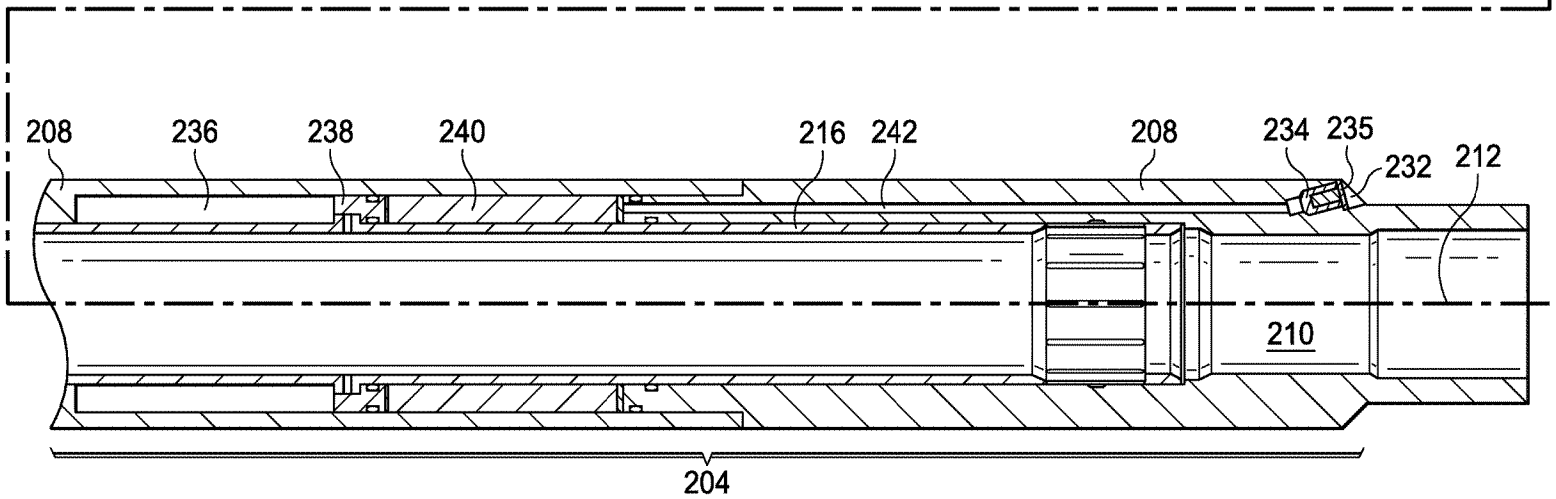

Now referring primarily to FIGS. 2A and 2B, a partial cross-sectional view is presented of an illustrative embodiment of an autonomous valve 200 having a sliding side door 202 coupled to a fluid-sensitive actuator 204 that contains a swellable piston. Specifically, FIG. 2A illustrates an upper portion of the autonomous valve 200 that includes the sliding side door 202, and FIG. 2B illustrates a connected lower portion thereof that includes the fluid-sensitive actuator 204. The autonomous valve 200 of FIG. 2 is analogous to the valve 102 of FIG. 1. The autonomous valve 200 includes a housing 208 having a throughbore 210 along a longitudinal axis 212. The housing 208 may be formed out of a single continuous tubular member or out of a series of sealingly-coupled tubular members as shown in FIGS. 2A and 2B. The housing 208 includes at least one flow port 214 extending from an exterior of the housing to the throughbore 210.

Disposed within the throughbore 210 and concentric with the longitudinal axis 212 is a sleeve 216. The sleeve 216 is movable between a first position that corresponds to an open valve, as shown in FIGS. 2A and 2B, and a second position that corresponds to a closed valve. The sleeve 216 may be in sealing engagement with the housing 208 to prevent undesirable migration of fluid from an exterior to an interior of the housing 208. For example, the sleeve 216 may be in sealing engagement to prevent a passage of production fluid from a wellbore into the housing 208 during deployment in a well. Sealing engagement of the sleeve 216 to the housing 208 may also prevent undesired leakage of fluid from the interior of the housing 208 to the exterior. A plurality of flow slots 218 perforate the sleeve 216 about a circumference and are axially-aligned with the at least one flow port 214 when the sleeve 216 is in the first position. While FIG. 2A depicts the plurality of flow slots 218 as an equispaced array of oblong perforations, this depiction is not intended as limiting. Other geometrical shapes, arrangements, or both are possible without departing from the scope of this disclosure.

Also disposed within the throughbore 210 and concentric with the longitudinal axis 212 is an intermediate cover 220. The intermediate cover 220 is nested in between the housing 208 and the sleeve 216 and is movable between a closed position, where the intermediate cover 220 occludes or blocks the at least one flow port 214, and an open position, where the intermediate cover 220 exposes the at least one flow port 214. FIG. 2A shows the intermediate cover 220 in the closed position. In the closed position, the intermediate cover 220 may form a fluid seal with the housing 208.

In an illustrative embodiment, the housing 208 further includes a piston 222 disposed within a cavity 224 of the housing 208. The cavity 224 is fully or partially defined by the boundaries of the housing 208 and the intermediate cover 220. The piston 222 is in sealing engagement with the housing 208, the intermediate cover 220, or both. The piston 222 is movable in a first stroke from an extended position to a retracted position which corresponds to a closed flow port 214 and in a second stroke from the retracted position to the extended position which corresponds to an open flow port 214. FIG. 2A shows the piston 222 in an extended position. The first (closing) stroke and the second (opening) stroke represent axial translations of the piston 222 along the longitudinal axis 212. In some embodiments, the piston 222 may be coupled by one or more shear pins 226 to the intermediate cover 220. In such embodiments, the one or more shear pins 226 may extend at least partially through each of the intermediate cover 220 and the piston 222. The one or more shear pins 226 provide a restraining force that holds the piston 222 in the extended position until the pins 226 are subjected to a sufficient force to cause the pins 226 to fail, freeing the piston 22 to move relative to the intermediate cover 220. Also disposed in the cavity 224 is a biasing member 228. The biasing member 228, which may be a spring, is configured to prejudice the piston 222 towards the extended position. Motion during the first (closing) stroke is therefore opposed by the biasing member 228 while motion during the second (opening) stroke is supported.

A traction device 230 is coupled to the piston 222 and configured to transmit force from the piston 222 to the intermediate cover 220 during the second stroke of the piston 222. Motion during the second stroke is operable to move the intermediate cover 220 from the closed position to the open position. In some embodiments, force is transmitted by interacting teeth on an inner radial surface of the traction device 230 with corresponding teeth on an outer radial surface of the intermediate cover 220. In such embodiments, the teeth may be configured to slide past each other during the first (opening) stroke, but engage to ratchet open the flow port during the second (closing) stroke.

In operation, to set or open the valve, an internal pressure is applied within the throughbore 210 that exceeds an exterior pressure outside the housing 208. A pressure differential is therefore produced across the piston 222 which induces motion from the extended position to the retracted position (i.e., the first stroke). To cause motion of the piston 222, the pressure differential establishes a force on one side of the piston 222 which is greater than that of an opposite side. In the first stroke, the greater force occurs on a side opposite the biasing member 228. Motion in the first stroke therefore occurs against an opposing force from the biasing member 228. The restraining force from the one or more shear pins 226 is also overcome to allow motion of the piston 222. When the internal pressure is subsequently relieved, the pressure differential across the piston 222 is reversed, allowing motion from the retracted position back to the extended position, resulting in the second (opening) stroke. During the second stroke, the traction device 230 engages the intermediate cover 220 and transmits a force that moves the intermediate cover 220 from the closed position to the open position. The throughbore 210 of the housing 208 is therefore exposed to the exterior of the housing 208 via the at least one flow port 214 and the plurality of flow slots 218 to allow production fluid to flow into the throughbore 210.

Now referring to FIG. 2B, but with continued reference to FIG. 2A, the housing 208 includes a fluid inlet 232 exposed to the exterior of the housing 208 and configured to receive fluid from a wellbore. The housing 208 also includes the fluid-sensitive actuator 204 which is operable to automatically actuate in response to being exposed to a target fluid. A soluble plug 234 is disposed between the fluid inlet 232 and the fluid-sensitive actuator 204. In an embodiment, the soluble plug 234 is soluble in the target fluid, but insoluble in the desired production fluid. Thus, the soluble plug 234 may be soluble upon exposure to one or more predetermined fluids or constituents therein that are not desired on the production fluid. For example, in a well that is expected to produce hydrocarbons, water may be an undesirable fluid, and may therefore be considered as the target fluid. Dissolution may occur after a specific concentration is reached, an exposure threshold is exceeded, or some combination thereof.

In some embodiments, the soluble plug 234 includes a soluble core that is formed of salt-sand matrix, a water-soluble sodium with metallic additives (a calcium phosphate glass or a phosphate polymer), or a water soluble solid glass such as any of the soluble alkaline silicates, such as a sodium silicate Na2(SiO2)nO, which may be, for example, sodium metasilicate (Na2SiO3). The rate of dissolution of the glass can be controlled over a wide range by changing the formulation. The salt-sand (silica) layer incorporates ionic compounds capable of dissolving upon exposure to water. Non-limiting examples of ionic compounds include salts containing sodium, potassium, and ammonium cations; nitrate- and acetate-based salts; chloride salts except silver (I) chloride, lead(II) chloride, and mercury(I) chloride; and sulfate salts except barium(II) sulfate, calcium(II) sulfate, and lead(II) sulfate. Other ionic compounds may also be used to form the soluble plug 234. In other embodiments, a protective layer 235 is included to cover and temporarily isolate the soluble plug 234. In such embodiments, the protective layer 235 is capable of dissolving in non-polar constituents of the production fluid. Non-limiting examples of protective layers include layers formed of natural rubber latex, triacylglycol, phospholipid, glycolipid, hydrophobic proteins, and aliphatic hydrocarbons.

The protective layer 235 first dissolves in the production fluid or non-polar constituents of the production fluid. For example, the protective layer 235 may dissolve in oil and not in water. The protective layer 235 therefore enables the soluble plug 234 or another actuator or sensor to survive exposure to the target fluid (or resist premature actuation) during transport or before the well is operational. Once subjected to hydrocarbon-bearing fluids, the protective layer may dissolve to expose the soluble plug 234 which, in its unprotected state, is responsive to exposure to the target fluid Fluid-sensitive actuator 204 also includes a chamber 236 defined by the housing 208 and the sleeve 216. A collar 238 is movably disposed within the chamber 236 and coupled to the sleeve 216. The collar 238 may be in sealing engagement with the housing 208, the sleeve 216, or both. In some embodiments, the collar 238 is coupled via a circumferential protrusion on an outer radial surface of the sleeve 216. In such embodiments, the circumferential protrusion provides a shoulder through which the collar 238 engages the sleeve 216. The collar 238 partitions the chamber 236 into a first chamber volume and a second chamber volume, the first chamber volume being in hydraulic equilibrium with the second chamber volume prior to actuator of the fluid-sensitive actuator 204. The fluid-sensitive actuator 204 also includes a swellable piston 240 that occupies the first chamber volume. In an embodiment, the swellable piston 240 is absorbent of the target fluid, but is inabsorbent of the production fluid. The swellable material 240 is operable to expand upon exposure to the target fluid, thereby increasing the first chamber volume at the expense of the second chamber volume. Examples of materials that expand in water are hydromorphic polymers which may expand up to five times their original size. The hydromorphic polymer may be, for example, medium density Polyethlene (MDPE). Another suitable material may be a rubber with a cellulose component, such as carboxy methyl cellulose. Other water swelling compounds such as a chloroprene type rubber can also be used. If a rubber material is used, the material may be adapted to include salts, super-absorbent fibers, or other water absorbing polymers to increase the ability of the material to swell in water. The collar 238 and the swellable piston 240 therefore function cooperatively to actuate the valve 200 in response to exposure to a target fluid.

A fluid-flow path 242 extends from the fluid inlet 232 to the chamber 236, and more specifically, to the first chamber volume. In some embodiments, a filter is disposed in between the fluid-flow path 242 and the first chamber volume. The filter may be used to prevent the swellable piston 240 from expanding into and unintentionally sealing the fluid-flow path 242. In some embodiments, the filter may even extend into the swellable piston 240 to ensure that the fluid inducing swelling is transmitted throughout the length of the swellable piston 240. The fluid-flow path 242 is operable to convey fluid from the fluid inlet 232 to the swellable piston 240 after the soluble plug 234 has been dissolved. In another embodiment, the swellable piston 240 may absorb and expand in the presence of any fluid. In such an embodiment, the fluid-sensitive actuator may actuate once the target fluid dissolves the soluble plug 234.

In operation, the fluid inlet 232 receives fluid from the wellbore, i.e., the production fluid, and conveys such fluid to the soluble plug 234. The soluble plug 234 dissolves when exposed to target fluid that occurs in the production fluid. For example, the soluble plug 234 may dissolve upon exposure to water in the production fluid after a predetermined period of time. The autonomous valve 200 may be in operation in the wellbore for some time before the production fluid contains actionable quantities of target fluid. In some embodiments, the soluble plug 234 includes or abuts the protective layer 235.

Dissolution of the soluble plug 234 may open the fluid inlet 232 and allow the fluid-flow path 242 to convey the production fluid to the chamber 236 of the swellable piston 240. The swellable piston 240 expands upon exposure to the target fluid, displacing the collar 238 within the chamber 236. The sleeve 216, being coupled to the collar 238, moves simultaneously and translates from the first sleeve position to the second sleeve position. Translation of the sleeve 216 towards the second sleeve position moves the plurality of flow slots 218 out of axial alignment with the flow ports 214. The flow ports 214 and valve 200 are thereby closed by the sleeve 216, halting fluid flow to the throughbore 210 from the exterior of the housing 208.

Figure 2C:
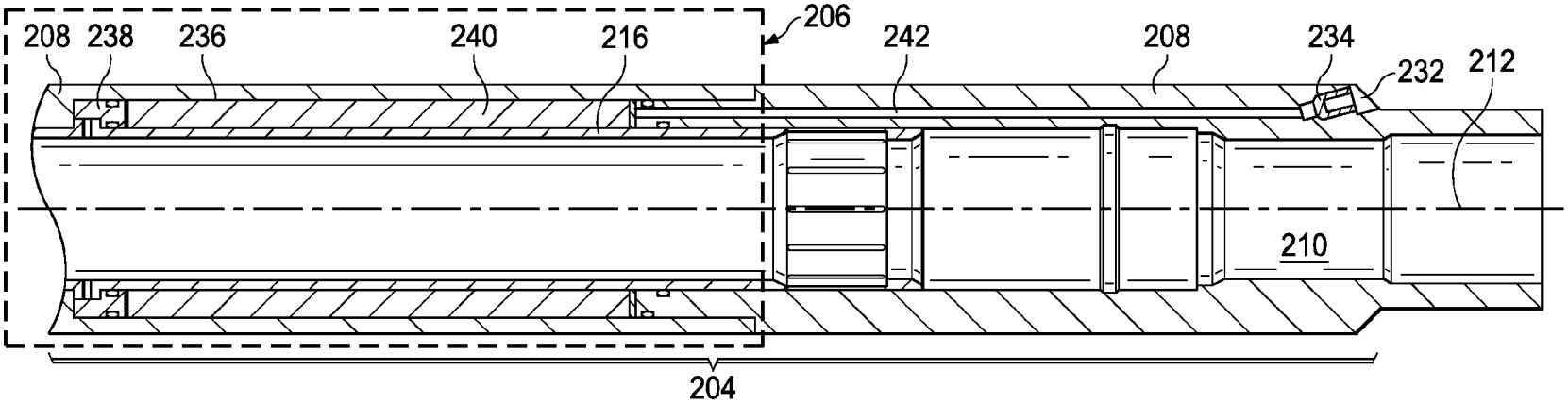
FIG. 2C is a detail, cross-sectional view of the fluid-sensitive actuator of FIG. 2B as actuated in response to exposure from a target fluid.

FIG. 2C illustrates, in a partial cross-sectional view, the fluid-sensitive actuator 204 of FIG. 2B as fully actuated in response to exposure from the target fluid. The soluble plug 234 is shown as dissolved and the swellable material 240 completely expanded to displace the collar 238 to one side of the chamber 236. Displacement of the collar 238, in turn, results in the sleeve 216 being displaced downward into the second, closed position, in which the sleeve covers the slots 218 and closes the valve 200.

Figure 3A:
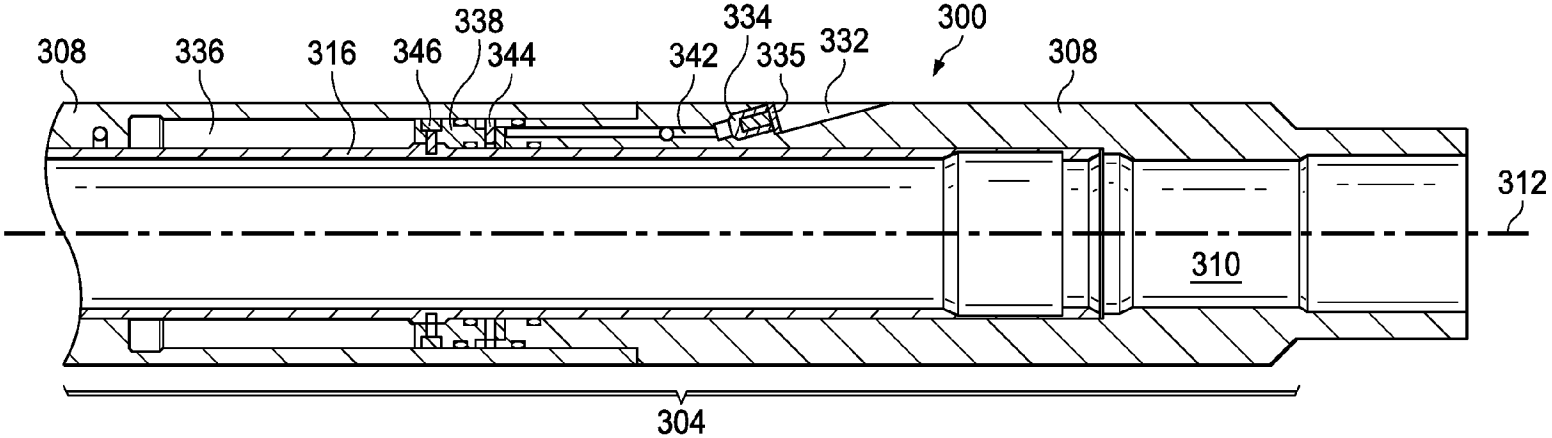
FIG. 3A is a cross-sectional view of an alternative embodiment of a fluid-sensitive actuator analogous to that of FIG. 2B in which the fluid-sensitive actuator contains a hydraulic piston.
Figure 3B:
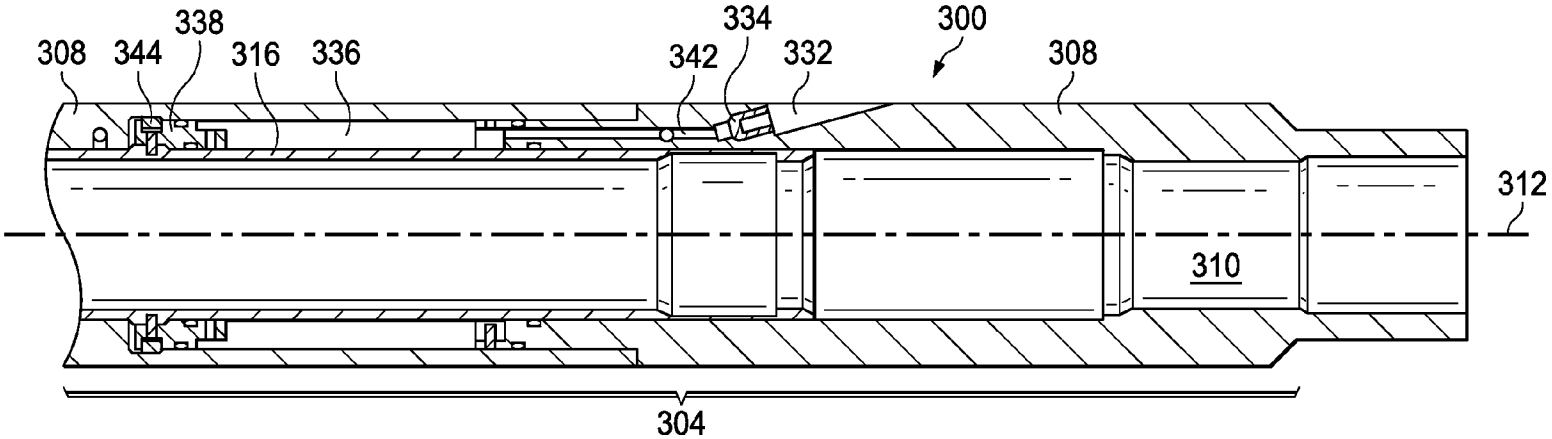
FIG. 3B is a detail, cross-sectional view of the fluid-sensitive actuator of FIG. 3A as actuated in response to exposure from a target fluid.

Now referring to FIGS. 3A and 3B, but with continued reference to FIG. 2A and FIG. 2B, a partial cross-sectional view is presented of an illustrative embodiment of a fluid-sensitive actuator 304. The fluid-sensitive actuator 304 is operable to automatically actuate in response to being exposed to a target fluid. The fluid-sensitive actuator 304 of FIG. 3A is analogous to the fluid-sensitive actuator 204 of FIG. 2B, and in some embodiments, is a continuation of the upper portion of the autonomous valve 200 depicted in FIG. 2A. In such embodiments, the fluid-sensitive actuator 304 functions as a part of an autonomous valve 300. Similar features common to both FIGS. 3A, 3B and 2B are related via coordinated numerals that differ in increment by a hundred. The fluid-sensitive actuator 304 includes a housing 308 having a throughbore 310 along a longitudinal axis 312. The housing 308 may be formed out of a single, continuous tubular member or out of a series of sealingly-coupled tubular members. Disposed within the throughbore 310 and concentric with the longitudinal axis 312 is a sleeve 316. The sleeve 316 is movable between a first position that corresponds to the valve 300 being open, as shown in FIG. 3A, and a second position (shown in FIG. 3B) that corresponds to the valve 300 being closed. In some embodiments, the sleeve 316 may be part of the sliding side door 202 illustrated by FIG. 2A, which is a continuation of the sleeve 216.

The housing 308 includes a fluid inlet 332 exposed to an exterior of the housing 308 that is configured to receive fluid from a wellbore, which may include the target fluid when hydrocarbon concentration of the production fluid is diminishing. A soluble plug 334 is disposed between the fluid inlet 332 and a hydraulic piston of the fluid-sensitive actuator 304. The soluble plug 334 is soluble in the target fluid, but insoluble in the production fluid. The soluble plug 334 is analogous to the soluble plug 234 described previously with regard to FIG. 2B. Similarly, the soluble plug 234 may be initially isolated from the external environment by a protective layer 335 that is analogous to the protective layer 235 described previously.

The fluid-sensitive actuator 304 includes a chamber 336 defined by the housing 308 and the sleeve 316. A fluid-flow path 342 extends from the fluid inlet 332 to the chamber 336. The fluid-flow path 342 is operable to convey fluid from the fluid inlet 330 to the hydraulic piston after the soluble plug 334 has been dissolved. In some embodiments, a filter may be disposed in between the fluid-flow path 342 and the chamber 336. In other embodiments, the chamber 336 and the fluid-flow path 342 are at a pre-actuation pressure not greater than atmospheric pressure prior to activation of the fluid-sensitive actuator 304.

A collar 338 which functions as a fluid motivated, or hydraulic, piston is movably disposed within the chamber 336 and coupled to the sleeve 316. The collar 338 is in sealing engagement with the housing 308, the sleeve 316, or both, such that fluid is generally not allowed to pass from one side of the collar 338 to the other within the chamber 336. In some embodiments, the collar 338 is coupled to a circumferential protrusion on an outer radial surface of the sleeve 316. In such embodiments, the circumferential protrusion provides a shoulder through which the collar 338 engages the sleeve 316. In addition, the collar 338 may be coupled by one or more shear pins 344 to the housing 308. In these embodiments, the one or more shear pins 344 may extend at least partially through each of the collar 338 and the housing 308. The one or more shear pins 344 are configured to resist motion of the collar 338 until a predetermined shear force is exceeded resulting from a pressure differential across the collar 338. After failure of the shear pins 344, the collar 338 is urged to move from a first collar position to a second collar position as fluid enters the chamber 336 to close the valve 300.

In an embodiment, a locking member 346 is coupled to the collar 338. The locking member 346 secures the collar 338 to the housing 308 when the second collar position is reached. When secured, the collar 338 is restrained from further movement. In some embodiments, the locking member 346 includes a locking pin biased towards an inner radial surface of the chamber 336. The locking pin extends at least partially through the collar 338, and may extend at least partially through the sleeve 316. In such embodiments, the locking pin accesses a mating recess in the inner radial surface of the chamber 336 when the collar 338 reaches the second collar position. Bias towards the inner radial surface is operable, upon access, to displace the locking pin into the mating recess.

In operation, the fluid inlet 332 receives fluid from the wellbore, i.e., the production fluid, and conveys such fluid to the soluble plug 334. The soluble plug 334 may ultimately dissolve upon exposure to the target fluid. For example, the soluble plug 334 may dissolve upon exposure to water in the production fluid after a predetermined period of time based on, for example the thickness of the plug, 234. Dissolution of the soluble plug 334 opens the fluid inlet 332 and allows the fluid-flow path 342 to convey the production fluid to the chamber 336 where it generates a force against the collar 338. The production fluid generates a hydrostatic a pressure differential across the collar 338. The one or more shear pins 344, if present, resist motion of the collar 338 until the pressure differential overcomes the predetermined shear force. The collar 338 then moves in response to the pressure differential, translating from the first collar position to the second collar position. The sleeve 316, being coupled to the collar 328, moves simultaneously and translates from the first sleeve position to the second sleeve position which results in the closing of the valve 300, as described above with regard to FIGS. 2A-2C. When the collar 338 reaches the second collar position, the locking member 346 secures the collar 338 to the housing 308, restraining the collar 338 from further movement. FIG. 3B illustrates the fluid-sensitive actuator 304 of FIG. 3A as fully actuated in response to exposure from the target fluid. The soluble plug 334 is shown as dissolved and the collar 338 translated to the second collar position. The locking member 346 is shown as securing the collar 338 to the housing 308. Consistent with the collar 338 being in the second collar position, the sleeve 316 is depicted in the second sleeve position.

Figure 4A:
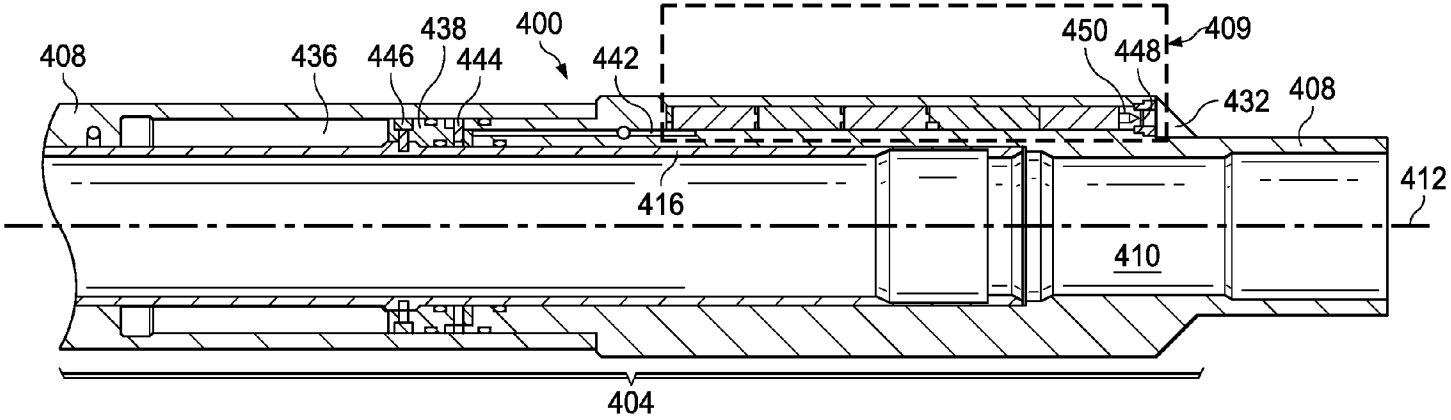
FIG. 4A is a detail, cross-sectional view of an alternative embodiment a fluid-sensitive actuator analogous to that of FIG. 2B in which the fluid-sensitive actuator contains a hydraulic piston and an electromagnetic actuator, according to an illustrated embodiment.
Figure 4B:
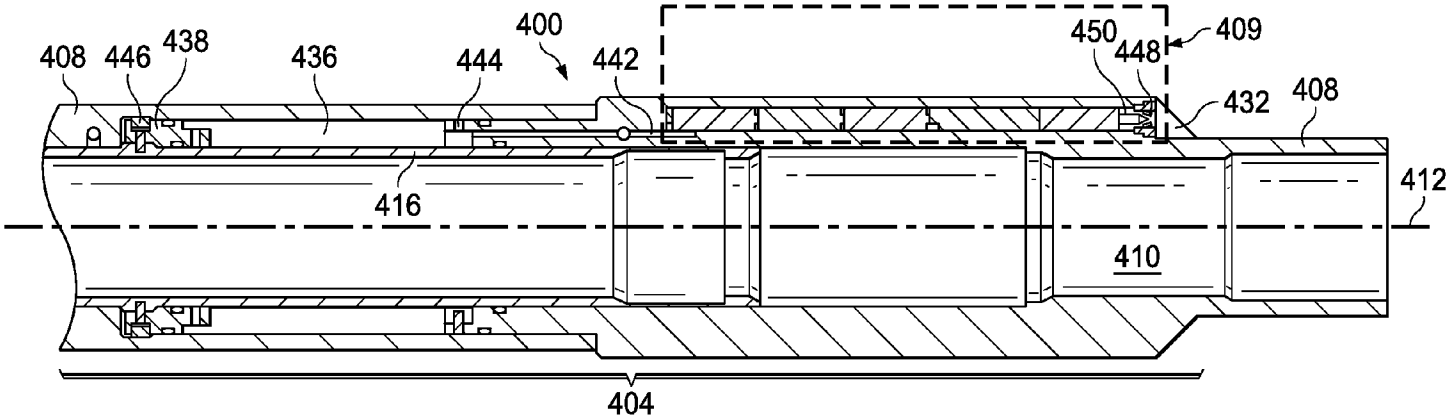
FIG. 4B is a detail, cross-sectional view of the fluid-sensitive actuator of FIG. 4A as actuated in response to exposure from a target fluid.

Now referring to FIGS. 4A and 4B, but with continued reference to FIGS. 2A-2C, a partial cross-sectional view is presented of a fluid-sensitive actuator 404 that includes an electromechanical actuator 409, according to an illustrative embodiment. The fluid-sensitive actuator 404 is operable to automatically actuate the valve 200 in response to being exposed to a target fluid. The fluid-sensitive actuator 404 of FIG. 4A is analogous to the fluid-sensitive actuator 204 of FIG. 2B, and in some respects, is a continuation of the upper portion of the autonomous valve 200 depicted in FIG. 2A. In such embodiments, the fluid-sensitive actuator 404 functions as part of an autonomous valve 400. Similar features common to both FIGS. 4A and 2B are related via coordinated numerals that differ in increment by two hundred. The fluid-sensitive actuator 404 includes a housing 408 having a throughbore 410 along a longitudinal axis 412. The housing 408 may be formed out of a single continuous tubular member or out of a series of sealingly-coupled tubular members. Disposed within the throughbore 410 and concentric with the longitudinal axis 412 is a sleeve 416. The sleeve 416 is movable between a first position that corresponds to the valve 200 being open, as shown in FIG. 4A, and a second position that corresponds to the valve 200 being closed (shown in FIG. 4B). In some embodiments, the sleeve 416 may be part of the sliding sealing member 202 illustrated by FIG. 2A.

The housing 408 includes a fluid inlet 432 exposed to an exterior of the housing 408 and configured to receive production fluid from a wellbore, which may include the target fluid as described previously. The electromechanical actuator 409 is disposed between the fluid inlet 432 and a collar 438 that functions as a fluid-translatable piston. The electromagnetic actuator 409 includes a rupture disk 448 exposed to the exterior of the housing 408. Proximate the rupture disk 448 is a thruster pin 450, which is oriented towards the rupture disk 448. The electromagnetic actuator 409 may further include a power source, a controller, and a sensor. In such embodiments, the sensor is coupled to the controller and operable to measure a parameter of the production fluid, such as its composition. As such, the sensor may be disposed at the inlet 432 outside of the rupture disk 448. Measurements taken by the sensor may include intermittent sampling of the fluid content or other fluid parameter at predetermined intervals. Non-limiting examples of such measurements include pressures, temperatures, fluid compositions, and fluid concentrations. The controller, coupled to the power source and the thruster pin 450, is configured to activate the thruster pin 450 when a trigger condition is detected. The power source may include a battery coupled to a charging device. The charging device may be configured to convert downhole energy sources (e.g., hydraulic, vibratory, etc.) into electrical energy for storage in the battery.

The fluid-sensitive actuator 404 includes a chamber 436 defined by the housing 408 and the sleeve 416. A fluid-flow path 442 extends from the fluid inlet 432 to the chamber 436. The fluid-flow path 442 is operable to convey fluid from the fluid inlet 432 to the fluid-translatable piston 438 after the electromechanical actuator 409 is activated. In some embodiments, a filter may be disposed in between the fluid-flow path 442 and the chamber 436. In other embodiments, the chamber 436 and the fluid-flow path 442 are at a pre-actuation pressure that is less than or equal to atmospheric pressure.

A collar 438 which functions as a fluid motivated or hydraulic piston, is movably disposed within the chamber 436 and coupled to the sleeve 416. The collar 438 is in sealing engagement with the housing 408, the sleeve 416, or both such that fluid is generally not allowed to pass from one side of the collar 338 to the other within the chamber 336. In some embodiments, the collar 438 is coupled to a circumferential protrusion on an outer radial surface of the sleeve 416. In such embodiments, the circumferential protrusion provides a shoulder through which the collar 438 engages the sleeve 416. In addition, the collar 438 may be coupled by one or more shear pins 444 to the housing 408. In these embodiments, the one or more shear pins 444 may extend at least partially through each of the collar 438 and the housing 408. The one or more shear pins 444 are configured to restrain motion of the collar 438 until a predetermined shear force is exceeded resulting from a pressure differential across the collar 438. After failure of the shear pins, 444, the collar 438 is urged to move from a first collar position to a second collar position as fluid enters the chamber 436.

In an embodiment, a locking member 446 is coupled to the collar 438. The locking member 446 secures the collar 438 to the housing 408 when the second collar position is reached. When secured, the collar 438 is restrained from further movement. In some embodiments, the locking member 446 includes a locking pin biased towards an inner radial surface of the chamber 436. The locking pin extends at least partially through the collar 438, and may extend at least partially through the sleeve 416. In such embodiments, the locking pin accesses a mating recess in the inner radial surface of the chamber 436 when the collar 438 reaches the second collar position. Bias towards the inner radial surface is operable, upon access, to displace the locking pin into the mating recess.

In operation, the fluid inlet 432 receives production fluid from the wellbore, and conveys such fluid to the sensor of the electromechanical actuator 409. The thruster pin 450 of the electromagnetic actuator 409 breaches the rupture disk 448 when a trigger condition is detected. For example, a trigger condition may be exposure to a very high concentration of an undesirable fluid, such as water, or the parameter of the production fluid 104 reaching the predetermined value.

It is noted that most oil and gas wells produce some water. There are, however, two types of water production in oil wells. The first type, usually occurring later in the life of a waterflood type of oil field, is water co-produced with oil because of the flow characteristics in porous rocks that make up the surrounding formation. A reduction of this water production would lead to reduced oil production unless the percentage of produced water is very high. The second type, which may be arrested or mitigated using the illustrative embodiments described herein directly competes with the oil production. This undesirable water flows into the wellbore through a different path than the oil, such as from cross flow, coning, or high-permeability water channels. In any of these cases, when the water content being produced from a particular zone reaches a threshold percentage, which may be, for example, a high percentage, 60%, 70%, 80%, 90%, or any other suitable threshold, the valve 400 is actuated to shut off the production zone. In general, the water percentage in a producing well may be determined by measuring the capacitance or impedance of the fluid. Since water has a high dielectric constant, and hence capacitance, it can be distinguished from oil or gas using an electronic sensor in contact with the water.

In some embodiments, the target fluid is water and the trigger condition is a predetermined concentration of water in the production fluid being detected by the sensor. In an embodiment, production well screens may be installed between packers in each zone. Such well screens may include, for example, the Halliburton EquiFlow® Autonomous ICD or other suitable devices which are used to slow the production of zones that are producing water using a fluid flow path into the production string that includes a vortex-inducing flow path. In such an embodiment, production fluid flowing through the well screen would also flow through the valve 400 which may be configured to close and cease the production of fluid from the zone in response to the concentration of water in the production fluid becoming very high or, for example, 90%.

In an embodiment, the electromagnetic actuator 409 may be programmed to not monitor for a trigger condition until a hydrocarbon-bearing fluid is detected to ensure that the electromagnetic actuator 409 does not close the valve 200 before the production string that includes the valve 200 is operational. Breaking of the rupture disk 448 opens the fluid inlet 432 and allows the fluid-flow path 442 to convey production fluid to the fluid-translatable piston 438. The production fluid enters the chamber 436, and upon doing so, generates a pressure differential across the piston 438.

The one or more shear pins 444, if present, resist motion of the piston 438 until the pressure differential overcomes the predetermined shear force. The piston 438 moves in response to the pressure differential, translating from the first collar position to the second collar position. The sleeve 416, being coupled to the collar 438, moves simultaneously and translates from the first sleeve position to the second sleeve position which closes the valve 200. When the collar 438 reaches the second collar position, the locking member 446 secures the collar 438 to the housing 408, restraining the collar 438 from further movement. FIG. 4B illustrates the fluid-sensitive actuator 404 as fully actuated in response to the detection of a trigger condition. The rupture disk 448 is shown as breached and the piston 438 translated to the second collar position. The locking member 446 is shown as securing the piston 438 to the housing 408 in the actuated position. Consistent with the piston 438 being in the second collar position, the sleeve 416 is depicted in the second sleeve position, which, as described previously, corresponds to the valve 400 being closed.

Figure 5:
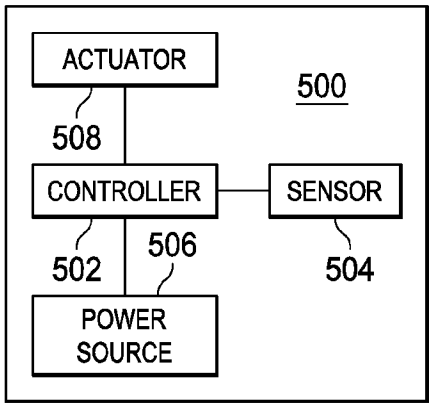
FIG. 5 is a block diagram of an electromagnetic actuator analogous to the electromagnetic actuator described in relation to FIGS. 4A and 4B.

Now referring primarily to FIG. 5, a schematic block diagram is presented of electromagnetic actuator 500 analogous to the electromagnetic actuator 409 described in relation to FIGS. 4A and 4B. The electromagnetic actuator 500 includes a controller 502 coupled to a sensor 504. The controller 502 is configured to receive signals from the sensor 504 that represent measurements of a parameter of the target fluid or the production fluid. Measurements taken by the sensor 504 may include intermittent sampling of the fluid content or other fluid parameter at predetermined intervals. Non-limiting examples of such measurements include pressures, temperatures, fluid compositions, and fluid concentrations. Also coupled to the controller 502 is a power source 506. The power source 506 may include a battery coupled to a charging device. The charging device may be configured to convert downhole energy sources (e.g., hydraulic, vibratory, etc.) into electrical energy for storage in the battery. An actuator 508 is coupled to the controller, and in some embodiments, may include a thruster pin oriented towards a rupture disk. In operation, the power source 506 supplies power to the controller 502 and the sensor 504. The sensor 504, in collaboration with the controller 502, monitors the parameter of the target fluid or the production fluid. When the parameter exceeds a threshold value, the controller 502 energizes the actuator 508 using power supplied by the power source 506.

According to an illustrative embodiment, a method for autonomously actuating a valve downhole in response to a production fluid from a wellbore includes breaching a frangible member, such as a rupture disk or soluble plug, that occludes a fluid inlet of a housing. The frangible member is configured to breach in response to a trigger condition. The trigger condition may be specific to a target fluid in the production fluid. The method also includes conveying the production fluid from the fluid inlet to a chamber of the housing. The method involves establishing a pressure differential across a collar movably arranged within the chamber using the conveyed production fluid to function as a piston. The pressure differential is operable to move the collar. The method includes engaging, with the collar, a sleeve movably arranged within a throughbore of the housing. The engaged sleeve moves from a first sleeve position to a second sleeve position and moves simultaneously with the collar in response to the pressure differential to actuate and close the valve.

In an embodiment, the method further includes applying an internal pressure to the throughbore of the housing thereby moving a piston in a first stroke from an extended position to a retracted position. The method also includes relieving the internal pressure within the throughbore thereby moving the piston in a second stroke from the retracted position to the extended position. The method involves transmitting a force to an intermediate cover movably nested in between the sleeve and the housing during the second stroke. The transmitted force is operable to move the intermediate cover from a closed position to an open position. Movement of the intermediate cover towards the open position unoccludes at least one flow port extending from an exterior of the housing to the throughbore. A plurality of flow slots perforates the sleeve and is axially-aligned with the at least one flow port when the sleeve is in the first sleeve position.

In an embodiment, a biasing member that opposes the motion of the piston during the first stroke and supports the motion of the piston during the second stroke. In some embodiments, breaching the frangible member includes dissolving a water-soluble plug with an aqueous constituent of the production fluid. In other embodiments, breaching the frangible member includes measuring the production fluid parameter with a sensor and activating a thruster pin to perforate a rupture disk when the production fluid parameter reaches the predetermined value.

Establishing the pressure differential may include partitioning the chamber into a first chamber volume and a second chamber volume using the collar and exposing a swellable material that occupies the first chamber volume to the aqueous constituent. The exposed swellable material is operable to expand in volume to displace the collar. In some embodiments, establishing the pressure differential includes impinging the conveyed production fluid against the collar to cause the collar to function as a fluid-motivated piston.

Although the present invention and its advantages have been disclosed in the context of certain illustrative, non-limiting embodiments, it should be understood that various changes, substitutions, permutations, and alterations can be made without departing from the scope of the invention as defined by the appended claims. It will be appreciated that any feature that is described in connection to any one embodiment may also be applicable to any other embodiment.

It will be understood that the benefits and advantages described above may relate to one embodiment or may relate to several embodiments. It will further be understood that reference to "an" item refers to one or more of those items.

The steps of the methods described herein may be carried out in any suitable order or simultaneous where appropriate. Where appropriate, aspects of any of the examples described above may be combined with aspects of any of the other examples described to form further examples having comparable or different properties and addressing the same or different problems.

The illustrative systems, methods, and devices described herein may also be described by the following examples:

EXAMPLE 1

A downhole, autonomous valve comprising:

a fluid inlet operable to receive fluid from a wellbore;

a fluid-sensitive actuator operable to automatically actuate the valve in response to being exposed to a target fluid; and a protective layer disposed between the fluid inlet and the fluid-sensitive actuator, the protective layer being insoluble in the target fluid.

EXAMPLE 2

The downhole, autonomous valve of example 1, wherein the protective layer is soluble in a hydrocarbon-bearing production fluid.

EXAMPLE 3

The downhole, autonomous valve of example 1 or 2, wherein the fluid-sensitive actuator comprises a swellable piston, the swellable piston comprising a material that is absorbent of the target fluid and inabsorbent of a hydrocarbon-bearing production fluid.

EXAMPLE 4

The downhole, autonomous valve of example 1 or 2, further comprising:

a soluble plug disposed between an exterior of the downhole, autonomous valve and a fluid inlet of the fluid-sensitive actuator, the soluble plug being soluble in the target fluid; and a fluid motivated piston coupled to a valve closing member disposed between the soluble plug and a chamber at a first pressure;

wherein the fluid motivated piston is operable to motivate the valve closing member to a closed position in response to fluid entering the fluid inlet at a wellbore pressure that is greater than the first pressure.

EXAMPLE 5

The downhole, autonomous valve of example 1 or 2, wherein the fluid-sensitive actuator comprises an electromechanical actuator having a controller, a power source, and an electronic sensor, wherein the fluid-sensitive actuator is operable to actuate the valve in response to the electronic sensor detecting a trigger condition.

EXAMPLE 6

The downhole, autonomous valve of example 5, wherein the trigger condition comprises the presence of water in the production fluid at a concentration that is greater than a predetermined concentration.

EXAMPLE 7

The downhole, autonomous valve of any of examples 1-6, wherein the target fluid is a production fluid containing at least a predetermined concentration of water.

EXAMPLE 8

An autonomous valve actuation system comprising:

a tubing segment, the tubing segment comprising a conduit and a valve, wherein the valve includes an inlet and an outlet, and defines a fluid flow path between the inlet and the outlet, and wherein the inlet is fluidly coupled to an exterior of the tubing segment and the outlet is fluidly coupled to the conduit;

wherein the valve comprises a fluid-sensitive actuator that is operable to close the valve in response to detecting a concentration of water in a production fluid that flows through the valve.

EXAMPLE 9

The system of example 8, further comprising a protective layer between a fluid inlet of the fluid-sensitive actuator and the exterior of the tubing segment.

EXAMPLE 10

The system of example 9, wherein the protective layer is soluble in a hydrocarbon-bearing production fluid.

EXAMPLE 11

The system of example 10, wherein the protective layer comprises a material selected from the group consisting of natural rubber latex, a triacylglycol, a phospholipid, a glycolipid, hydrophobic proteins, and aliphatic hydrocarbons.

EXAMPLE 12

The system of examples 8-11, wherein the fluid-sensitive actuator comprises a swellable piston, the swellable piston comprising a material that is absorbent of the water and inabsorbent of a hydrocarbon-bearing production fluid.

EXAMPLE 13

The system of examples 8-11, wherein the fluid-sensitive actuator comprises:

a soluble plug disposed between the exterior of the tubing segment and a fluid inlet of the fluid-sensitive actuator, the soluble plug being soluble in the target fluid; and a fluid motivated piston coupled to a valve closing member disposed between the soluble plug and a chamber at a first pressure;

wherein the fluid motivated piston is operable to motivate the valve closing member to a closed position in response to fluid entering the fluid inlet of the fluid-sensitive actuator at a wellbore pressure that is greater than the first pressure.

EXAMPLE 14

The system of example 13, wherein the soluble plug comprises a material selected from the group consisting of sodium cations, potassium cations, ammonium cations, nitrate-based salts, acetate-based salts, chloride salts, and sulfate salts

EXAMPLE 15

The system of examples 8-11, wherein the fluid-sensitive actuator comprises an electromechanical actuator having a controller, a power source, and an electronic sensor, wherein the fluid-sensitive actuator is operable to actuate the valve in response to the electronic sensor detecting a trigger condition

EXAMPLE 16

A method of autonomously actuating a valve, the method comprising:

operating a tubing segment in a wellbore, the tubing segment including a conduit and a valve, wherein the valve includes an inlet and an outlet, and defines a fluid flow path between the inlet and the outlet, and wherein the inlet is fluidly coupled to an exterior of the tubing segment and the outlet is fluidly coupled to the conduit;

receiving a production fluid from a geological formation to the valve inlet;

detecting a target fluid in the production fluid; and closing the valve in response to detecting the target fluid;

wherein detecting the target fluid and closing the valve comprises a fluid-sensitive actuator autonomously detecting the target fluid and closing the valve.

EXAMPLE 17

The method of example 16, wherein:

the fluid-sensitive actuator comprises a swellable piston, the swellable piston comprising a material that is absorbent of the target fluid and inabsorbent of a hydrocarbon-bearing production fluid;

detecting the target fluid comprises absorbing the target fluid with the swellable piston; and closing the valve in response to detecting the target fluid comprises the swellable piston enlarging and actuating a valve closing member.

EXAMPLE 18

The method of example 16, wherein:

the fluid-sensitive actuator comprises a soluble plug disposed between the exterior of the tubing segment and a fluid inlet of the fluid-sensitive actuator, the soluble plug being soluble in the target fluid, and a fluid motivated piston coupled to a valve closing member that is disposed between the soluble plug and a chamber at a first pressure;

detecting the target fluid comprises the target fluid dissolving the soluble plug; and closing the valve in response to detecting the target fluid comprises the fluid motivated piston motivating a valve closing member to a closed position in response to fluid entering the fluid inlet of the fluid-sensitive actuator at a wellbore pressure that is greater than the first pressure.

EXAMPLE 19

The method of example 18, wherein the soluble plug comprises a material selected from the group consisting of sodium cations, potassium cations, ammonium cations, nitrate-based salts, acetate-based salts, chloride salts, and sulfate salts

EXAMPLE 20

The method of example 16, wherein:

the fluid-sensitive actuator comprises an electromechanical actuator having a controller, a power source, an electronic sensor, and a fluid motivated piston coupled to a valve closing member, the fluid motivated piston being disposed between the a fluid inlet of the fluid-sensitive actuator and a chamber at a first pressure;

EXAMPLE 21 detecting the target fluid comprises detecting the target fluid with the electronic sensor; and closing the valve in response to detecting the target fluid comprises opening the fluid inlet of the fluid-sensitive actuator to allow fluid from the wellbore to engage the fluid motivated piston to force the valve closing member to a closed position in response to the fluid entering the fluid inlet at a wellbore pressure that is greater than the first pressure.

It will be understood that the above description of the embodiments is given by way of example only and that various modifications may be made by those skilled in the art. The above specification, examples, and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the scope of the claims.

We claim:

1. A downhole, autonomous valve comprising:

a fluid inlet operable to receive fluid from a wellbore;

a fluid-sensitive actuator operable to automatically close the valve in response to being exposed to a target fluid, the fluid sensitive actuator comprising a piston comprising a swellable material that is absorbent of the target fluid and inabsorbent of a hydrocarbon-bearing production fluid;

a soluble plug disposed between an exterior of the downhole, autonomous valve and a fluid-sensitive actuator fluid inlet, the soluble plug being soluble in the target fluid; and a protective layer disposed between the exterior of the downhole, autonomous valve and the soluble plug, the protective layer being insoluble in the target fluid.

2. The downhole, autonomous valve of claim 1, wherein the protective layer is soluble in a hydrocarbon-bearing production fluid.

3. The downhole, autonomous valve of claim 1, wherein the target fluid is a production fluid containing at least a predetermined concentration of water.

4. An autonomous valve actuation system comprising:

a tubing segment, the tubing segment comprising a conduit and a valve, wherein the valve includes an inlet and an outlet, and defines a fluid flow path between the inlet and the outlet, and wherein the inlet is fluidly coupled to an exterior of the tubing segment and the outlet is fluidly coupled to the conduit; wherein the valve comprises a fluid-sensitive actuator that is operable to close the valve in response to detecting a target fluid, the fluid sensitive actuator comprising a piston comprising a swellable material that is absorbent of the target fluid and inabsorbent of a hydrocarbon-bearing production fluid;

a soluble plug disposed between the exterior of the tubing segment and a fluid-sensitive actuator fluid inlet, the soluble plug being soluble in the target fluid; and a protective layer between the soluble plug and the exterior of the tubing segment, the protective layer being insoluble to the target fluid.

5. The system of claim 4, wherein the protective layer is soluble in a hydrocarbon-bearing production fluid.

6. The system of claim 5, wherein the protective layer comprises a material selected from the group consisting of natural rubber latex, a triacylglycol, a phospholipid, a glycolipid, hydrophobic proteins, and aliphatic hydrocarbons.

7. The system of claim 4, wherein the soluble plug comprises a material selected from the group consisting of sodium cations, potassium cations, ammonium cations, nitrate-based salts, acetate-based salts, chloride salts, and sulfate salts.

8. The system of claim 4, wherein the target fluid is a production fluid containing at least a predetermined concentration of water.

9. A method of autonomously actuating a valve, the method comprising:

operating a tubing segment in a wellbore, the tubing segment including a conduit and the valve, wherein the valve includes an inlet and an outlet, and defines a fluid flow path between the inlet and the outlet, and wherein the inlet is fluidly coupled to an exterior of the tubing segment and the outlet is fluidly coupled to the conduit;

receiving a production fluid from a geological formation to the valve inlet;

dissolving a protective layer between a fluid-sensitive actuator fluid inlet of a fluid-sensitive actuator of the valve and the exterior of the tubing segment with the production fluid, the protective layer insoluble to a target fluid;

dissolving a soluble plug disposed between the exterior of the tubing segment and the fluid-sensitive actuator fluid inlet with a target fluid in the production fluid; and closing the valve via a piston of the fluid-sensitive actuator in response to dissolving the soluble plug with the target fluid, the piston comprising a swellable material that is absorbent of the target fluid and inabsorbent of a hydrocarbon-bearing production fluid.

10. The method of claim 9, wherein the soluble plug comprises a material selected from the group consisting of sodium cations, potassium cations, ammonium cations, nitrate-based salts, acetate-based salts, chloride salts, and sulfate salts.

* * * * *